US007503645B2

(12) United States Patent
Miyasaka et al.

(10) Patent No.: US 7,503,645 B2
(45) Date of Patent: Mar. 17, 2009

(54) DROPLET GENERATOR AND INK-JET RECORDING DEVICE USING THEREOF

(75) Inventors: Toru Miyasaka, Hitachinaka (JP); Yuichiro Sano, Mito (JP); Mamoru Okano, Hitachi (JP); Tomohiro Inoue, Tsukuba (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/527,719

(22) Filed: Sep. 27, 2006

(65) Prior Publication Data

US 2007/0146441 A1 Jun. 28, 2007

(30) Foreign Application Priority Data

Dec. 26, 2005 (JP) ..... 2005-371281

(51) Int. Cl.
*B41J 2/02* (2006.01)

(52) U.S. Cl. ..... 347/73

(58) Field of Classification Search ..... 347/73–83
See application file for complete search history.

(56) References Cited

U.S. PATENT DOCUMENTS

| | | | | |
|---|---|---|---|---|
| 3,373,437 | A | 3/1968 | Sweet et al. | |
| 3,739,393 | A | 6/1973 | Lyon et al. | |
| 3,777,307 | A | 12/1973 | Duffield | |
| 4,005,435 | A * | 1/1977 | Lundquist et al. | 347/75 |
| 4,095,232 | A | 6/1978 | Cha | |
| 4,346,389 | A * | 8/1982 | Nagayama | 347/76 |
| 4,350,986 | A * | 9/1982 | Yamada | 347/75 |
| 4,520,369 | A | 5/1985 | Shackleton | |
| 5,912,686 | A * | 6/1999 | Palmer et al. | 347/75 |
| 6,357,866 | B1 * | 3/2002 | van Rensburg | 347/75 |
| 6,505,920 | B1 | 1/2003 | Braun | |
| 6,637,801 | B1 | 10/2003 | Eustache et al. | |
| 2005/0179743 | A1 * | 8/2005 | Hirota et al. | 347/65 |
| 2007/0064068 | A1 * | 3/2007 | Piatt et al. | 347/75 |

FOREIGN PATENT DOCUMENTS

| | | |
|---|---|---|
| EP | 0 283 226 A2 | 9/1988 |
| EP | 0 461 238 B1 | 4/1995 |

(Continued)

OTHER PUBLICATIONS

European Search Report issued in European Patent Application No. EP 06020594.5, dated Apr. 5, 2007.

(Continued)

*Primary Examiner*—Luu Matthew
*Assistant Examiner*—Justin Seo
(74) *Attorney, Agent, or Firm*—McDermott Will & Emery LLP

(57) ABSTRACT

A droplet generator comprising a first unit having an elongate liquid chamber one end thereof is open and at least one raw of orifices disposed in a line oppositely to the open end in the longitudinal direction of the first unit, a second unit having an elongate diaphragm provided on the bottom of the second unit and a plurality of vibrators provided within the diaphragm area, a vibrating apparatus provided on the top of the vibrators, and a stationary section to fix the vibrating apparatus. The diaphragm of the second unit is provided closely and oppositely to the open end of the liquid chamber of the first unit.

13 Claims, 7 Drawing Sheets

FOREIGN PATENT DOCUMENTS

| | | | | |
|---|---|---|---|---|
| EP | 0 819 062 | B1 | | 1/1999 |
| EP | 0 943 436 | B1 | | 7/2006 |
| JP | 58197057 | A | * | 11/1983 |
| JP | 63120657 | A | * | 5/1988 |
| WO | WO 98/08685 | | | 3/1998 |

OTHER PUBLICATIONS

Takeshi Amari, ed., "Technolgies & Materials for Inkjet Printer," 1998, CMC Publishing CO., Ltd.

* cited by examiner

DROPLET GENERATOR AND INK-JET RECORDING DEVICE USING THEREOF

CLAIM OF PRIORITY

The present application claims priority from Japanese application serial No. 2005-371281, filed on Dec. 26, 2005, the content of which is hereby incorporated by references into this application.

BACKGROUND OF THE INVENTION

1. Field of Technology

This invention relates to an ink-jet recording device and, more particularly, to a droplet generator in a multi-nozzle continuous ink-jet apparatus which can eject ink droplets very steadily with high reliability and high maintainability.

2. Prior Art

The basic principle of operation of a multi-nozzle continuous ink-jet apparatus is explained below. Flying micro droplets are formed by compressing liquid in an ink tank by a pump or the like, letting liquid be ejected from an orifice, and applying vibrations to the ejected liquid by a piezoelectric element. Then the flying droplets are given charges by a charge electrode which is placed near the stream of droplets and have the controlled amounts of charge. The flying direction and the quantity of deflection of each charge-controlled droplet are controlled by a deflection electrode which is provided in the downstream side of the charge electrode. This controlling is done to form an image or pattern according to its information. Unwanted droplets that are not used for image or pattern formation are controlled to fly into a gutter which is provided in part of the flying path of the droplets. The liquid in the gutter is fed back to the ink tank for re-use.

In addition to this multi-nozzle continuous ink-jet type, there is a drop-on-demand ink-jet type which controls ejection of each droplet. This ink-jet type uses small ink chambers made of piezoelectric elements and deforms respective ink chambers by piezoelectric elements to eject droplets. Another well-known drop-on-demand ink-jet type provides a heater in each ink chamber, overheats liquid in the ink chamber by the heater to form a bubble, and pushes out liquid by the pressure of the bubble.

Contrarily, the continuous ink-jet apparatus need not control ejection of each droplet because it controls the charge quantity of ejected liquid to deflect its flying direction. Therefore, the continuous ink-jet type is simpler than the drop-on-demand type and can assure high reliability. Consequently, the continuous ink-jet apparatus has been widely used as industrial marking apparatus which requires a long service life and high reliability. Details of these ink-jet types and industrial marking apparatus which uses the continuous ink-jet apparatus are explained in detail by Non-Patent Document 1.

As explained by Non-Patent Document 2, many of the continuous ink-jet apparatuses for industrial marking use a single nozzle and control the quantity of deflection of the ejected liquid to form images. However, to use the long-life high-reliability continuous ink-jet apparatus in various fields, the continuous ink-jet apparatus must be of the multi-orifice type that uses a plurality of orifices to eject ink.

To realize a continuous ink-jet apparatus of the multi-orifice type, the most important problem is to form uniform droplets from a plurality of parallel orifices. For this purpose, some methods have been proposed.

Patent Documents 1 to 4 disclose a method of vibrating an orifice plate by piezoelectric elements. However, it is difficult to vibrate the orifice plate uniformly by piezoelectric elements in spite of various contrivances. Because of generation of a mode of plate vibration or a vibration mode, this method has a demerit that droplet generation timing and quantities may vary by the positions of orifices formed in the orifice plate.

Patent Documents 5 and 6 disclose a method of vibrating the whole ink chamber. This method requires much vibration energy as the liquid and the whole ink chamber must be vibrated. Further, it is hard to increase the vibration frequency in this method. Generally, the droplet generation frequency must be some kHz to 10 kHz considering the productivity. At the present time, the droplet generation frequency of the drop-on-demand ink-jet apparatus is about 10 to 20 kHz and that of the continuous ink-jet apparatus is 100 kHz or higher. Further, it is hard to increase the vibration frequency of the ink-jet type that vibrates the whole ink chamber because the vibration load is great.

Patent Document 7 discloses a method of vibrating the orifice plate which contains a plurality of orifices from its side and forming droplets by using propagation of a pressure wave of the liquid. This method using the propagation of a liquid pressure wave cannot generate droplets simultaneously from all orifices and makes the later control such as droplet charge control and droplet deflection control complicated. Further, this method also has a stability problem since the pressure wave propagation path is long and waves reflected on the surrounding walls may have a bad influence on droplet generation.

Patent Document 8 discloses a method of providing piezoelectric elements opposite to the orifice plate and vibrating the liquid thereby. This method is assumed to be able to generate droplets most uniformly since the piezoelectric elements can vibrate the liquid uniformly in parallel with the orifice plate. However, the piezoelectric elements in this method must generate uniform flexible deformation on the orifice plate. Therefore, this makes the structure of the piezoelectric elements very complicated. Further, the quantity of deformation of each piezoelectric element is not so big and a value in nanometers. As this method directly vibrates liquid, this method requires comparatively great deformation of each piezoelectric element. This requires a structural device and greater supply voltages.

Patent Documents 9 and 11 disclose a method of equipping each piezoelectric element with a resonator which is opposite to the orifice plate. The resonator amplifies the vibration force of the piezoelectric element to a vibration force of comparatively great amplitude. Further, this method places the vibrating resonators oppositely to the orifice plate to vibrate liquid uniformly in parallel with the orifice plate. In other words, this method can use very small energy to generate liquid droplets by amplifying a comparatively small displacement of a piezoelectric element by a resonating material. However, this method requires controlling the vibration manner of resonators that vibrate by piezoelectric elements to the desired vibration manner.

[Patent Document 1] U.S. Pat. No. 3,739,393
[Patent Document 2] U.S. Pat. No. 3,777,307
[Patent Document 3] U.S. Pat. No. 6,357,866
[Patent Document 4] EP0943436
[Patent Document 5] EP0461238
[Patent Document 6] U.S. Pat. No. 6,505,920
[Patent Document 7] EP0819062
[Patent Document 8] U.S. Pat. No. 4,520,369
[Patent Document 9] U.S. Pat. No. 6,637,801
[Patent Document 10] WO98/08685
[Patent Document 11] U.S. Pat. No. 5,912,686

[Non-Patent Document 1] "Inkjet Printer Technologies and Materials" edited by Takeshi Amari, published by CMC, 1998

SUMMARY OF THE INVENTION

Methods of Patent Documents 8 to 11 also have some problems to be solved.

The first problem is that the vibrations made by piezoelectric elements transfer to the unit of the ink-jet apparatus and cause unwanted secondary vibrations and resonances. If transferred to the unit and other surrounding members, the vibrations may be affected by the fixing structure of the unit and other factors and further the whole ink chamber is vibrated abnormally. This makes the vibrations and droplet ejections unstable.

Patent Document 8 discloses a method of using an acoustic material to fixing the piezoelectric elements to the unit to prevent vibrations of the piezoelectric elements from transferring to the unit. Further, Patent Documents 9 and 10 are assumed to use a seal member that seals liquid in the ink chamber to fix the piezoelectric elements to the unit. However, its details are not found in the documents. However, in the structure in which the unit is placed close to the vibrating member with an acoustic material therebetween, however, it is hard to completely suppress transfer of vibrations. When the deterioration of the acoustic material with age is considered, the stability will not be assured. A method of Patent Document 11 suppresses vibrations from transferring to the unit by placing a thin sheet-like diaphragm on one end of the vibrator when fixing the vibrator to the unit. Fixing of piezoelectric elements and structures of resonators and diaphragms to suppress transfer of vibrations are very significant to this structure.

The second problem is to vibrate liquid uniformly. To generate uniform and steady ink droplets from a plurality of orifices, it is necessary to vibrate very uniformly an elongate wall surface that is provided opposite to the elongate orifice row. However, as the vibrating surface or the vibrator becomes longer, vibrations may be more inhomogeneous in the longitudinal direction. Generally, when a member is moved to shrink and expand, the greatest displacement is apt to generate in the longest direction. If this stretching vibration along the row of orifices cannot be absorbed appropriately, the elongate vibrator may generate uneven vibrations such as distortions and undulations in the longitudinal direction.

The structure of Patent Document 8 that vibrates liquid by deformation of piezoelectric elements employs a plurality of orthogonal slits in the longitudinal direction of the orifice row or in the longitudinal direction of piezoelectric elements to suppress the longitudinal elastic movement of the piezoelectric elements. The structure of Patent Document 10 that uses resonators divides a piezoelectric element into some pieces to suppress deformation in the direction of the orifice row or in the longitudinal direction of the ink chamber and vibrate the resonator in the orifice direction. However, also in this structure, the resonator is assumed to shrink and expand both in the orifice direction and in the longitudinal direction, the vibration of the resonator may be uneven if the vibrator is held improperly. The structure of Patent Document 11 suppresses longitudinal flexible motion by dividing a piezoelectric element into some pieces and also applying slits to resonators that contain piezoelectric elements.

However, the longitudinal flexible motion cannot be suppressed completely even by dividing piezoelectric elements and applying slits to resonator. The structures of Patent Documents 8 through 10 which place an acoustic material between the unit and the vibrating member that are close to each other cannot absorb the longitudinal flexible motion completely and may give a bad influence to the liquid vibration.

Contrarily, the structure of Patent Document 11 provides a diaphragm structure on the upper end of the vibrator that is connected to the unit. This structure can generate comparatively stable vibrations in the orifice direction since the longitudinal flexible motion of the resonator is not suppressed in the unit. However, even the structure of Patent Document 11 contains a factor to make droplet generation unstable. This is because the whole elongate resonator is immersed in the ink chamber. In this structure, not only the end surface of the resonator opposite to the orifice but also its side surface is in contact with liquid. Therefore, unwanted vibrations may be applied to the liquid and may cause instability of the generated droplets.

The third problem that is the last and most important problem is to simplify the structure. An ink-let apparatus may have a problem of clogging orifices when the apparatus uses liquid that disperses pigment or dye particles in liquid. Therefore, while the ink-jet apparatus must be able to eject droplets very steadily and reliably, the ink-jet apparatus must facilitate its disassembly, cleaning, and reassembly for recovery from a problem if occurred. So, a simple structure that can be easily disassembled, cleaned, and reassembled is much required by the droplet generator of the ink-jet apparatus.

The structure of Patent Document 8 is very complicated. It firmly inserts a piezoelectric element of a complicated shape into a clearance of the unit with an acoustic material therebetween and places a separating sheet member between the ink chamber and the piezoelectric element. Contrarily, the structures of Patent Documents 9 and 10 are simple but it is assumed that the resonator section cannot be easily disassembled judging from the elastic member between the resonator and the unit and the liquid seal structure. The lid-like structure of Patent Document 11 separates the resonator by a diaphragm and it is assumed that the structure can be easily disassembled for maintenance. However, the structure cannot be machined at high precision because the piezoelectric element is embedded and the resonator structure is very complicated.

In consideration of the above conditions, an object of this invention is to provide a high-stability continuous multi-orifice ink-jet apparatus that has high reliability and maintainability using a droplet generator enable to solve the above three problems.

To solve the above problems, the basic structure of the liquid ejecting means is a two-unit structure having first and second units. The first unit is equipped with an elongate ink chamber and a row of a plurality of orifices which are formed on a wall opposite to the open surface of the ink chamber. The second unit is equipped with a diaphragm which is made of a diaphragm member provided closely and oppositely to the open surface of the ink chamber of the first unit and a resonance vibration member (resonator) provided on the other surface of the diaphragm structure which is not in the ink chamber side. Further, in the structure, a piezoelectric element is connected to one end surface of the second unit which is not in the diaphragm side of the resonator. The resonator of the second unit disposes a plurality of columnar members along the row of the orifices.

The following three structures of the resonator and the ink chamber are added to the above basic structure.

In the first structure, the resonance vibration member (resonator) of the second unit is made of a plurality of rod-like structures each of which is elongated along the vibration of the diaphragm. The plurality of rod-like structures has a bonding structure to be unified with the structures respectively at a side connected to the diaphragm and at the opposite side. This bonding structure is configured to fix a vibration member (resonator) such as a piezoelectric element to the side opposite to the resonator.

The second structure is at least one step on the rod-like resonator. The step-to-step distance is determined so that the resonators may have a plurality of resonance frequencies near a preset vibration frequency.

The third structure is a plurality of grooves, steps, or other structures provided on the wall of the ink chamber. These structures are provided perpendicularly to the diaphragm and in parallel to the diaphragm. The distances between the plurality of grooves or steps which are perpendicular to the diaphragm are so short as to generate resonance frequencies which are fully higher than the preset vibration frequency. The distances between the plurality of grooves or steps which are in parallel to the diaphragm are determined so that the resonance frequency of the liquid may be a plurality of resonance frequencies near the preset vibration frequency.

DETAILED DESCRIPTION OF THE INVENTION

One embodiment of this invention will be explained below with reference to FIG. 1 to FIG. 12.

Embodiment 1

Figure 1:
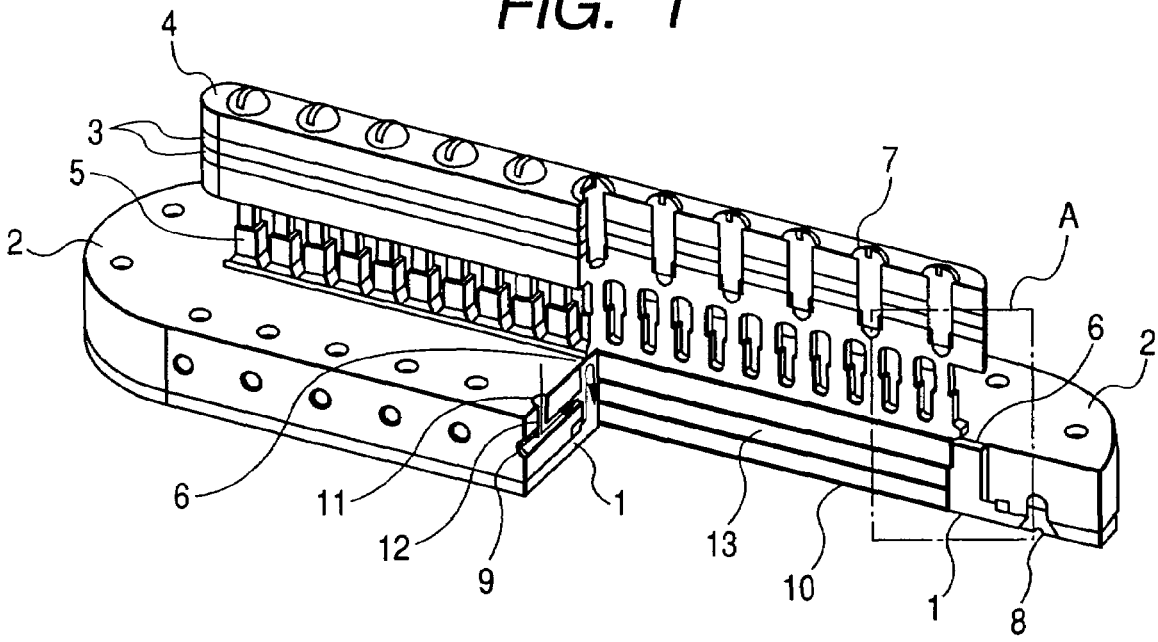
FIG. 1 shows the external view and the internal structure of a droplet generator which is an embodiment of this invention.
Figure 2:
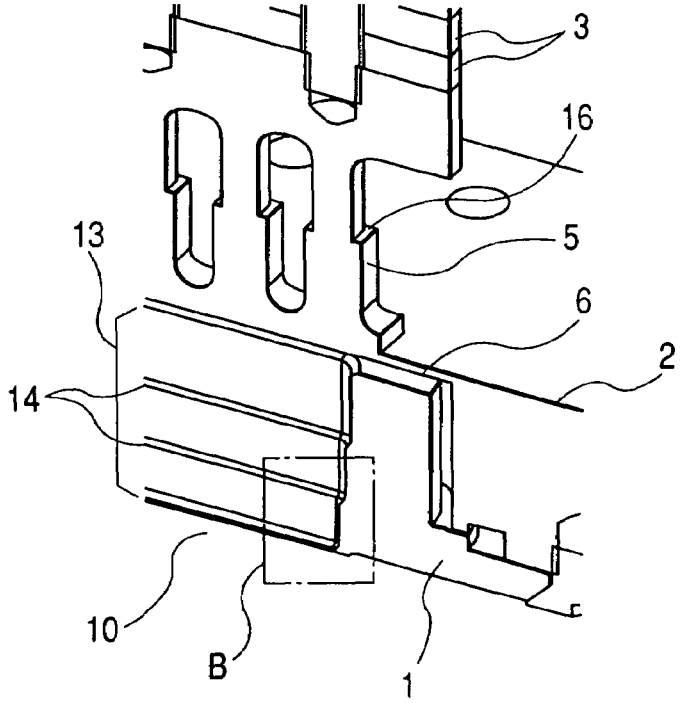
FIG. 2 is a magnified view of part A of the cut-away area of FIG. 1 for explanation of the details.
Figure 3:
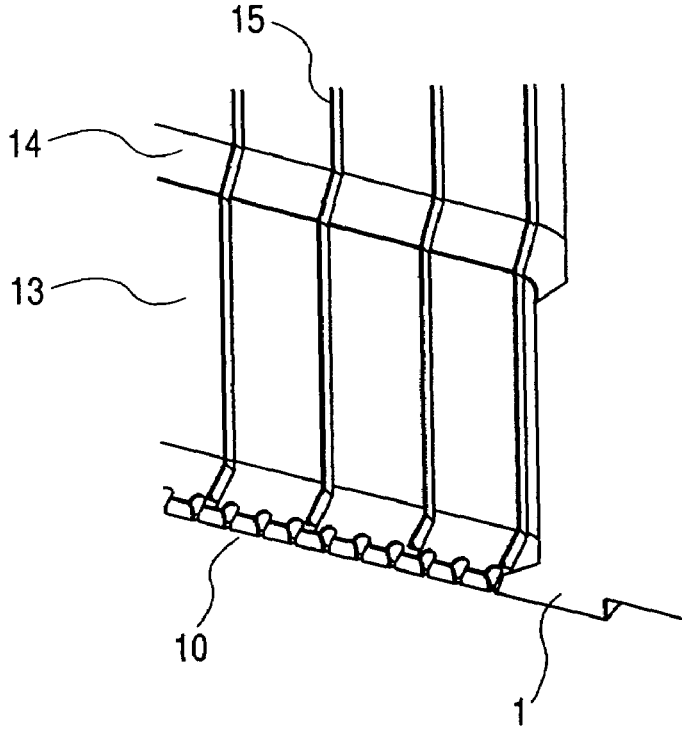
FIG. 3 shows a magnified view of part B of FIG. 1 to explain details of the ink chamber and orifices.
Figure 4:
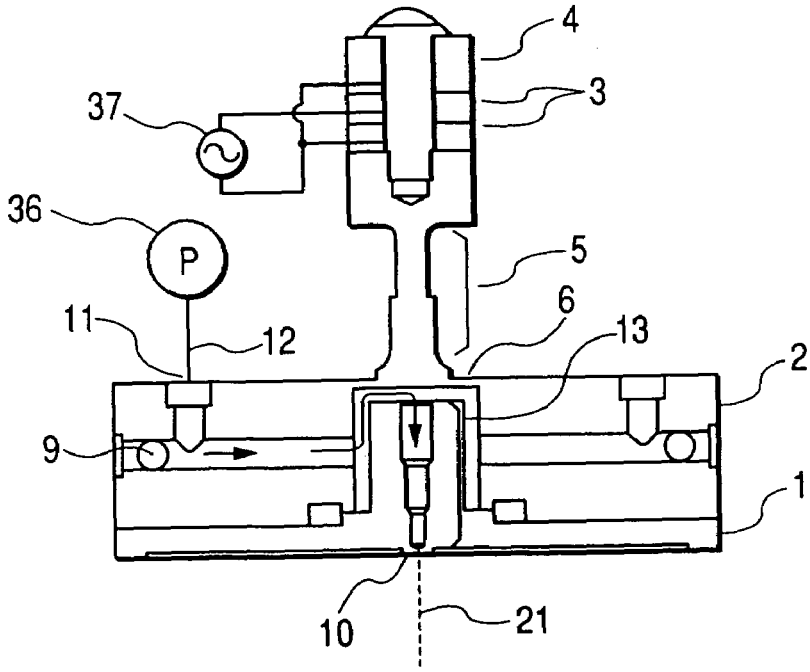
FIG. 4 shows the transverse sectional view of the center part of the droplet generator in FIG. 1.
Figure 5:
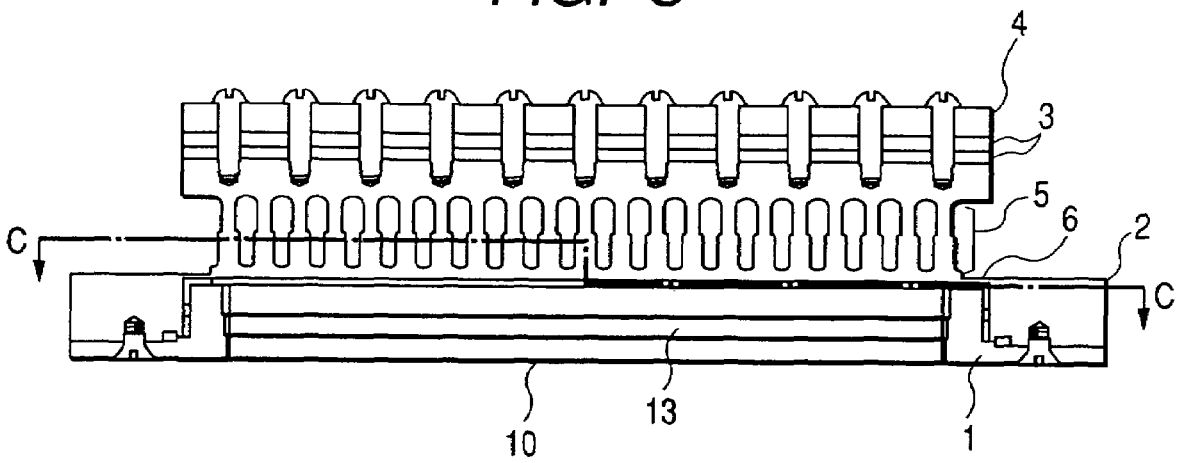
FIG. 5 shows the longitudinal sectional view of the center part of the droplet generator in FIG. 1.
Figure 6:
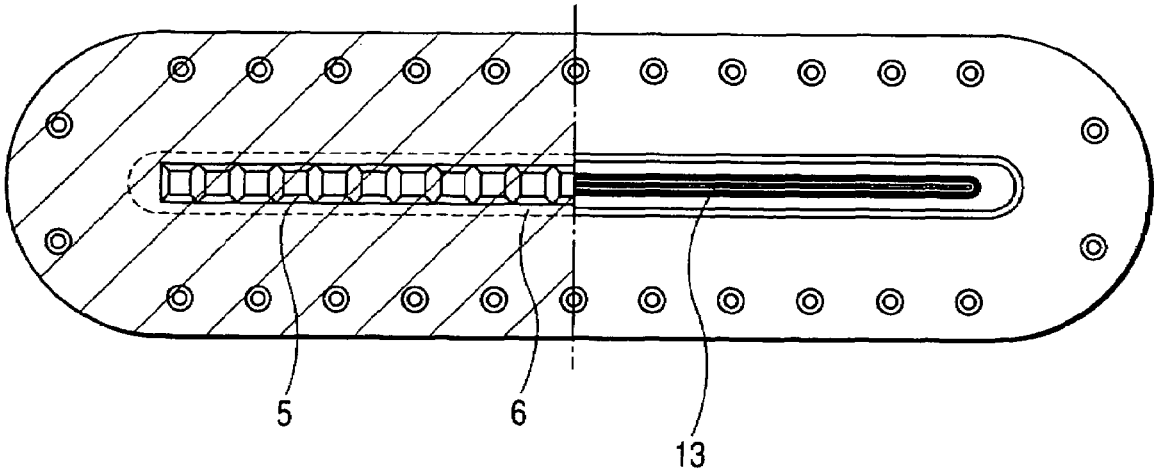
FIG. 6 shows the cross sectional view taken along the line C-C of FIG. 5 to explain the relationship of the resonator, the diaphragm, and the ink chamber.

FIG. 1 to FIG. 6 show a droplet generator of an ink-jet apparatus which is an embodiment of this invention. FIG. 1 shows the external view of a droplet generator whose front right quarter is cut away to show its internal structure. FIG. 2 is a magnified view of part A of the cut-away area of FIG. 1 for explanation of the details. FIG. 3 shows a magnified view of part B of FIG. 2 to explain details of the ink chamber and orifices. FIG. 4 and FIG. 5 respectively show the transverse and longitudinal sectional views of the center part of the droplet generator in FIG. 1. FIG. 6 shows the cross sectional view taken along the line C-C of FIG. 5 to explain the relationship of the resonator, the diaphragm, and the ink chamber.

The droplet generator of FIG. 1 to FIG. 6 comprises two units: first unit 11 and second unit 2. The first unit contains elongate ink chamber 13 having openings on the upper end in the center of first unit 1. One row of orifices 10 are longitudinally provided on the lower end of ink chamber 13.

Second unit 2 is designed and assembled to cover first unit 1 and provides a thin film member (diaphragm 6) which is an elongate vibrating plate on the position opposite to the upper open end of ink chamber 13 of first unit 1. Elongate diaphragm 6 has vibrating section 5 which contains a plurality of columnar structures in the center. FIG. 6 shows a cross-sectional view of the center of the vibrating section and the top of the ink chamber. Oval diaphragm 6 is provided to cover the open area on the upper end of the oval ink chamber. A row of vibrating sections 5 which are a plurality of columnar structures is disposed in the center of the oval diaphragm. The upper end of vibrating section 5 made of the plurality of columnar structures is a unified structure having a preset area. The lower end of vibrating section 5 is unified with diaphragm 6. Further, the columnar structures of vibrating section 5 are thicker in the lower end and stepped in the upper end. The diaphragm section, the vibrating section, and the unified structure of the upper end are cut out from part of the second unit. In other words, these are in a body with second unit 2.

Two layers of flat piezoelectric elements 3 whose shapes are almost the same as the unified structure are laid on the top of the unified structure which is on the top of vibrating section 5. Further, counterweight member 4 is placed on the top of the lamination of piezoelectric element 3 to sandwich the piezoelectric element layers between counterweight member 4 and vibrating section 5. The counterweight member 4 and the lamination of piezoelectric element 3 are fastened to a plate bonded to the top of the vibrating section 5 with screws 7.

The top of the second unit on which vibrating section 5 is provided has a plurality of ports 11 to supply liquid to the ink chamber on its periphery. Liquid is supplied into ink chamber 13 of the first unit in the arrow direction through liquid supply route 12 of FIG. 1 and FIG. 4. Ball member 9 in liquid supply route 12 is provided to close unnecessary part of liquid supply route 12. The unnecessary part of liquid supply route 12 is always formed when the bent liquid supply route 12 is formed by drilling the top surface and the side surface of the second unit 2. Therefore, ball member 9 is used to close the unnecessary side drill hole. As supplemental information, all shapes of the unit of the droplet generator in accordance with this invention except drilled orifices 10 are so simple as to be machined satisfactorily by general milling. However, orifices 10 are several tens of micrometers in-diameter and several hundreds of micrometers in hole pitch and requires high-precision machining (drilling, punching, electrospark machining, and etching).

Next, the droplet generation of this invention will be explained mainly using FIG. 4. FIG. 4 shows the transverse sectional view of the center part of the droplet generator in FIG. 1 which is an embodiment of this invention. Liquid is compressed by pump 36 and supplied through a plurality of liquid supply ports 11 which are provided on the periphery of second unit 2. Liquid is supplied to ink chamber 13 in first unit 1 through liquid supply route 12. Diaphragm section 6 having columnar vibrating section 5 in the center is provided oppositely to the top of the ink chamber. Piezoelectric element 3 and counterweight 4 are fixed to the top of the vibrating section. In this embodiment, two layers of piezoelectric elements 3 are laminated. A piezoelectric element driving power supply 37 of a constant voltage and a frequency for vibration is connected to both ends of the layers. When power is supplied, the layers of piezoelectric elements 3 vibrate vertically (in the longitudinal direction of the page). It is easy to increase the amplitude of vibration by increasing the number of layers of piezoelectric element 3. Further, it is possible to control the amplitude of vibration by increasing the supply voltage. The number of piezoelectric element layers and the supply voltage must be controlled according to droplet generating conditions. Generally, the supply voltage is in the range of 10 to 300 V. This embodiment uses a supply voltage of 100 to 200 V for steady droplet generation.

The resonance frequency of the columnar structure which is the vibrating section 5 is controlled according to the vibration frequency and the amplitude of vibration is increased. The vibrating section 5 vibrates the diaphragm which is provided oppositely to ink chamber 13 at amplitude of several hundreds of nanometers to several micrometers. With this, liquid in ink chamber 13 is vibrated. Liquid compressed and supplied by pump 36 is ejected from a plurality of orifices 10 in ink chamber 13 at a pump pressure only and separated into droplets 21 when vibrations are applied to the liquid in ink chamber 13.

As shown in FIG. 1, FIG. 2, FIG. 4, and FIG. 5, vibrating section 5 contains step structure 16. The step structure 16 is provided to generate at least two resonance frequencies in the direction of elongation, that is, in the vertical direction and stabilize droplet generation.

Figure 7:
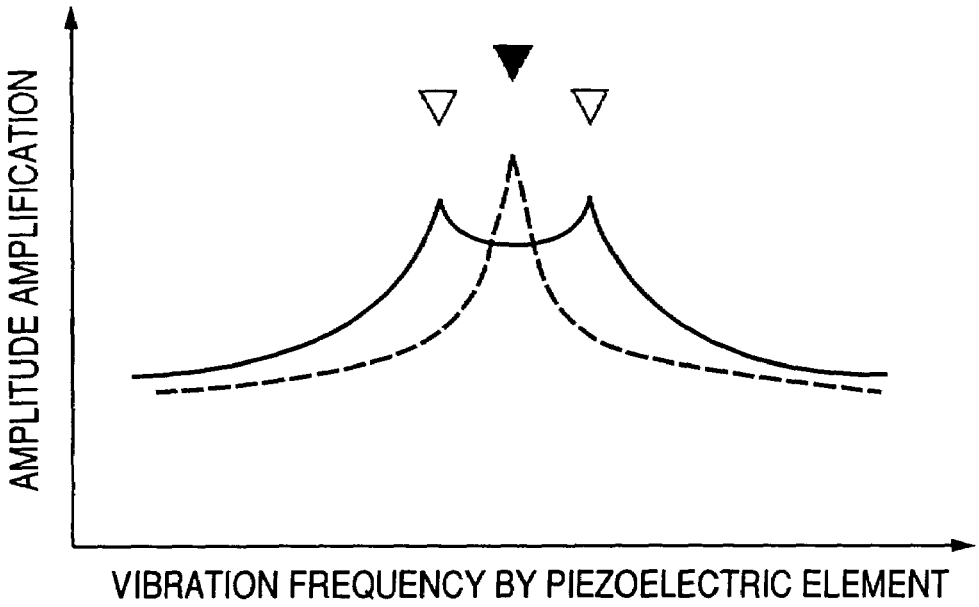
FIG. 7 shows graphs representing relationships between vibration frequency and amplitude amplification ratio to explain the effect of steps provided on the resonance vibration member.

FIG. 7 shows graphs representing relationships between vibration frequency and amplitude amplification ratio for the columnar structures without a step and for the columnar structures with a step in vibrating section 5. The solid curves in the figure are for stepped vibrating section 5 and the dotted lines are for unstepped vibrating section 5.

As shown by the dotted line in FIG. 7, in the case there is one resonance frequency, when a vibration is made near the resonance frequency which is pointed out by a black inverse triangle, the amplitude can be amplified very much. However, the magnitude of amplitude changes steeply as the vibration frequency goes away even a little from the resonance frequency. So, this embodiment gives step structure 16 to vibrating section 5 so that vibrating section 5 may have a plurality of resonance frequencies (pointed out by white inverse triangles) at both side of the preset resonance frequency which is pointed out by a black inverse triangle. The relationship between frequency and amplitude is indicated by solid curves in FIG. 7. As shown in FIG. 7, a comparative broad amplitude area can be formed between two resonance points (indicated by white inverse triangles) which are provided at both sides of a desired vibration frequency. With this, a stable amplitude amplification can be obtained near the desired vibration frequency.

Another possible method to stabilize the amplitude amplification is vibrating while changing the vibration frequency of piezoelectric element 3 in a predetermined range. This vibration frequency range can suppress change in the amplitude amplification due to shifting of a resonance frequency in this range. In this case, however, it is necessary to appropriately set the range of a frequency given to the piezoelectric element and its fluctuation pattern. The use of an appropriate step structure 16 in the vibrating section 5 and a vibration frequency range of the piezoelectric element 3 will enable assurance of more stable amplitude amplification. In other words, vibrating section 5 works as a resonance member and vibrates the diaphragm at preset amplitude. Consequently, liquid in the ink chamber is compressed and pushed out through orifices.

FIG. 5 shows the longitudinal sectional view of the center part of the droplet generator in FIG. 1 which is an embodiment of this invention. As shown in FIG. 3, orifices 10 to eject droplets are disposed along the length of ink chamber 13 and an elongate diaphragm structure is provided along the elongate ink chamber. A columnar structure which is the vibrating section 5 of FIG. 4 is provided oppositely to ink chamber 13. Further, piezoelectric element 3 and counterweight 4 are placed on the vibrating section 5. In this configuration, since diaphragm 6 opposite to the top of the ink chamber can vibrate up and down along the length of the elongate ink chamber 13, liquid in the ink chamber 13 is uniformly vibrated. With this, liquid ejected from orifices 10 can be turned into droplets uniformly and simultaneously.

FIG. 2 and FIG. 3 respectively show magnified views of the internal structure of ink chamber 13 in the droplet generator of FIG. 1 which is an embodiment of this invention. As shown in the figure, inside ink chamber 13 of this embodiment, a plurality of step structures 14 are formed from the diaphragm 6 to orifices 10. These step structures are provided to control influence of liquid resonance by vibration.

Liquid in ink chamber 13 also has some resonance frequencies that are determined by shapes and lengths of the ink chamber 13 and other conditions. The magnitude of vibration is affected also by these resonance frequencies of liquid due to the vibration frequency. Particularly, the acoustic velocity in liquid depends much on liquid temperatures. Therefore, to accomplish stable droplet generation, it is necessary to provide a structure that can suppress influence of a specific resonance frequency on liquid vibration or to provide a structure that can suppress change of vibration levels due to fluctuation of resonance frequencies.

Step structure 14 in Figs. like the step structure of the columnar structures of vibrating section 5 are designed so that liquid in the ink chamber may have a plurality of resonance frequencies (pointed out by white inverse triangles) at both sides of the preset vibration frequency. The step-step distance depends upon droplet properties and target frequencies. If the vibration is in the range of some tens of kHz to 100 kHz, the step-step distance is some millimeters to some centimeters.

Further, to suppress resonance vibration components as much as possible in the ink chamber, it is effective to make the resonance frequency of liquid in the ink chamber fully higher than the vibration frequency. If the vibration frequency is some tens of kHz to 100 kHz, the ink chamber must be designed so that the resonance frequency of liquid in the ink chamber may be several hundreds of kHz or more. Also in this case, the step-step distance must be some millimeters or less although it depends upon droplet properties.

As shown in FIG. 3, this embodiment forms a plurality of step structures 15 which are perpendicular to the width direction of the ink chamber. These step structures are provided to suppress vibrations of liquid in the ink chamber in the width direction of the ink chamber. If the liquid vibrates in the width direction of the ink chamber, timing to generate droplets in orifices may not be stable. Therefore, the liquid vibration along the width direction of the ink chamber must be suppressed as much as possible. For this purpose, this embodiment makes the resonance frequency along the width direction of the ink chamber higher than the vibration frequency by providing a plurality of step structures 15 which are perpendicular to the width direction of the ink chamber. Also in this case, the step-step distance depends on droplet properties. The step structures are disposed at intervals of some millimeters or less so that the resonance frequencies of the liquid may be several hundreds of kHz or less.

In the structure of the embodiment of FIG. 2 and FIG. 3, step structures 15 are provided to assure a preset stable amplification of vibrations which propagate from diaphragm 6 to the orifices and to suppress width vibrations in the ink chamber. With this, this embodiment can generate stable droplets in the width direction of the ink chamber under a condition that a low voltage is supplied to piezoelectric elements 3.

Further, in this embodiment, vibrating section 5 on diaphragm 6 is made of a plurality of columnar structures. If vibrating section 5 is made of a unified sheet structure instead of these columnar structures, the elongation toward diaphragm 6 becomes smaller at the same supply voltage to the piezoelectric elements. Therefore, these columnar structures of vibrating section 5 increase the elongation toward diaphragm 6 and obtains greater amplitudes at a lower supply voltage to the piezoelectric elements 3. Further, the unified sheet structure of vibrating section 5 is apt to increase the elongation towards diaphragm 6 and the elongation along the width direction of the ink chamber, consequently distort the whole vibrating section 5, and make the vibration unstable. The plurality of columnar structures of vibrating section 5 absorb the width elongation and assures stable vibrations of diaphragm 6.

However, if the columnar structures of vibrating section 5 are made excessively thin or spaced wider, the vibration of diaphragm 6 on the top of the ink chamber becomes uneven. To prevent this, the embodiment optimizes the thickness of the columnar structures and unified respective ends (lower and upper ends) of the columnar structures. This enables the columnar structures and diaphragm 6 to vibrate the top of the ink chamber 13 approximately in a body. Although the above description assumes that diaphragm 6, vibrating section 5, and the top of vibrating section 5 are cut out in a body from the second unit, they can be prepared separately and bonded together later with adhesives or the like. In this case, it is necessary to select adhesives that will not be affected by the bonding sections.

Next will be explained the configuration of the whole ink-jet head which uses the droplet generator of this invention and its printing operation with reference to FIG. 8 to FIG. 11.

Figure 8:
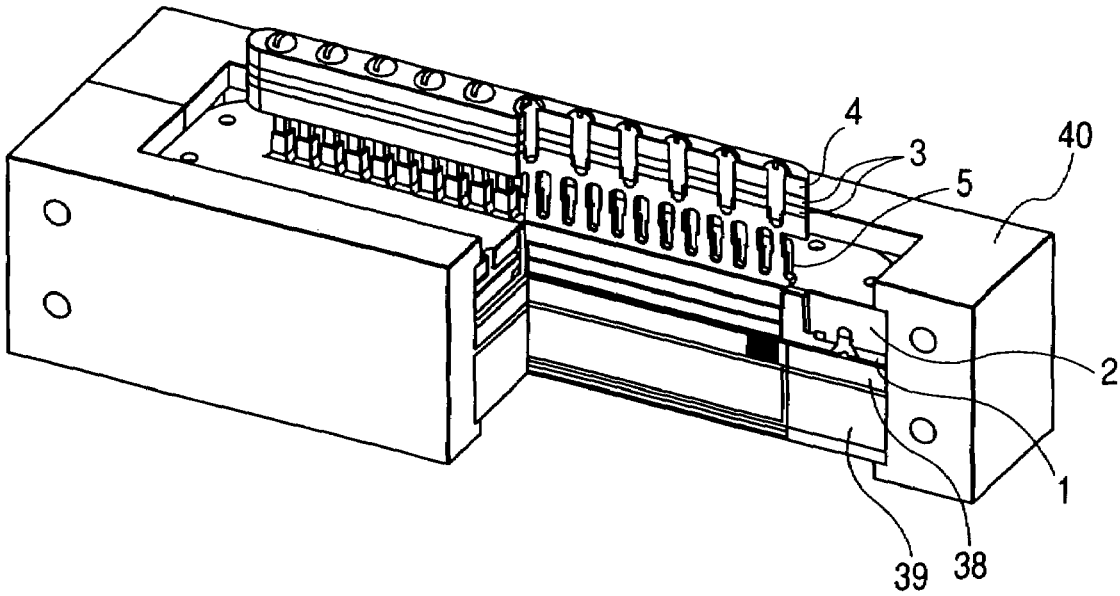
FIG. 8 shows the appearance and the internal structure of the ink-jet head equipped with the droplet generator of this invention.
Figure 9:
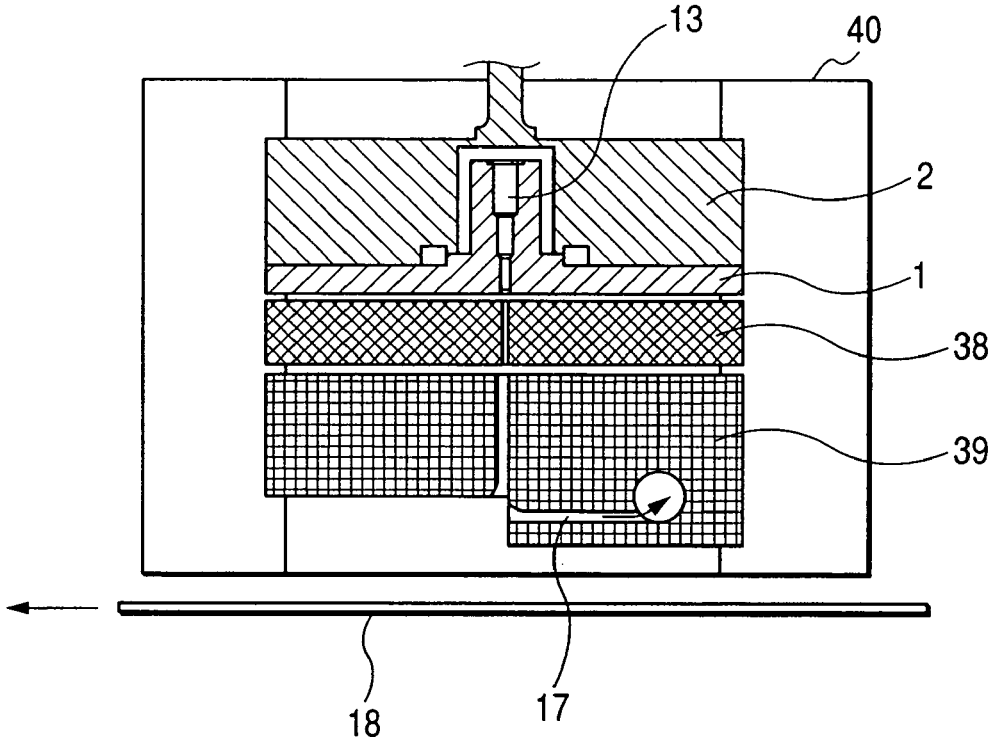
FIG. 9 shows the transverse sectional views of the center part of the ink-jet head of FIG. 8.
Figure 10:
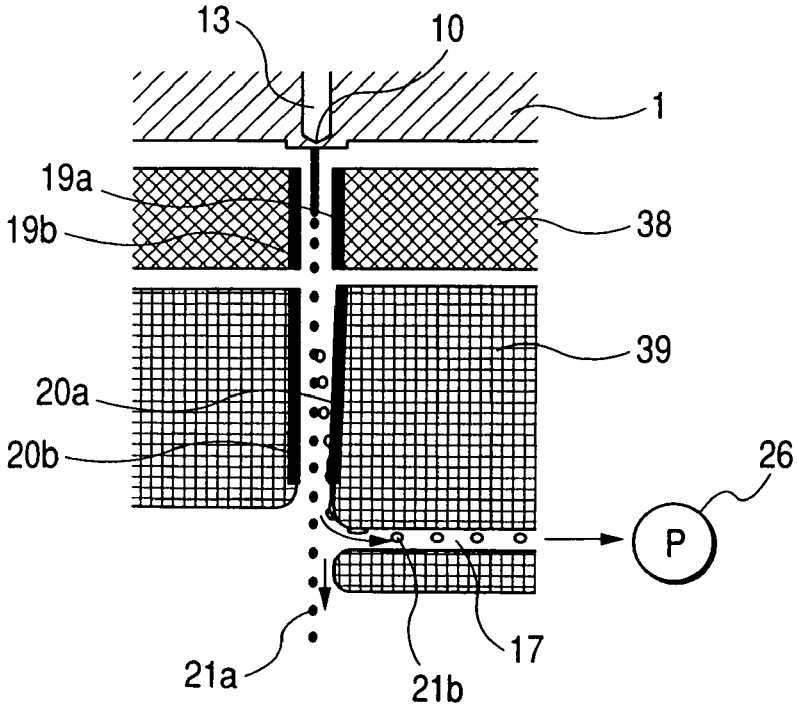
FIG. 10 is the magnified view of FIG. 9 to explain the flying status of ink droplets.
Figure 11:
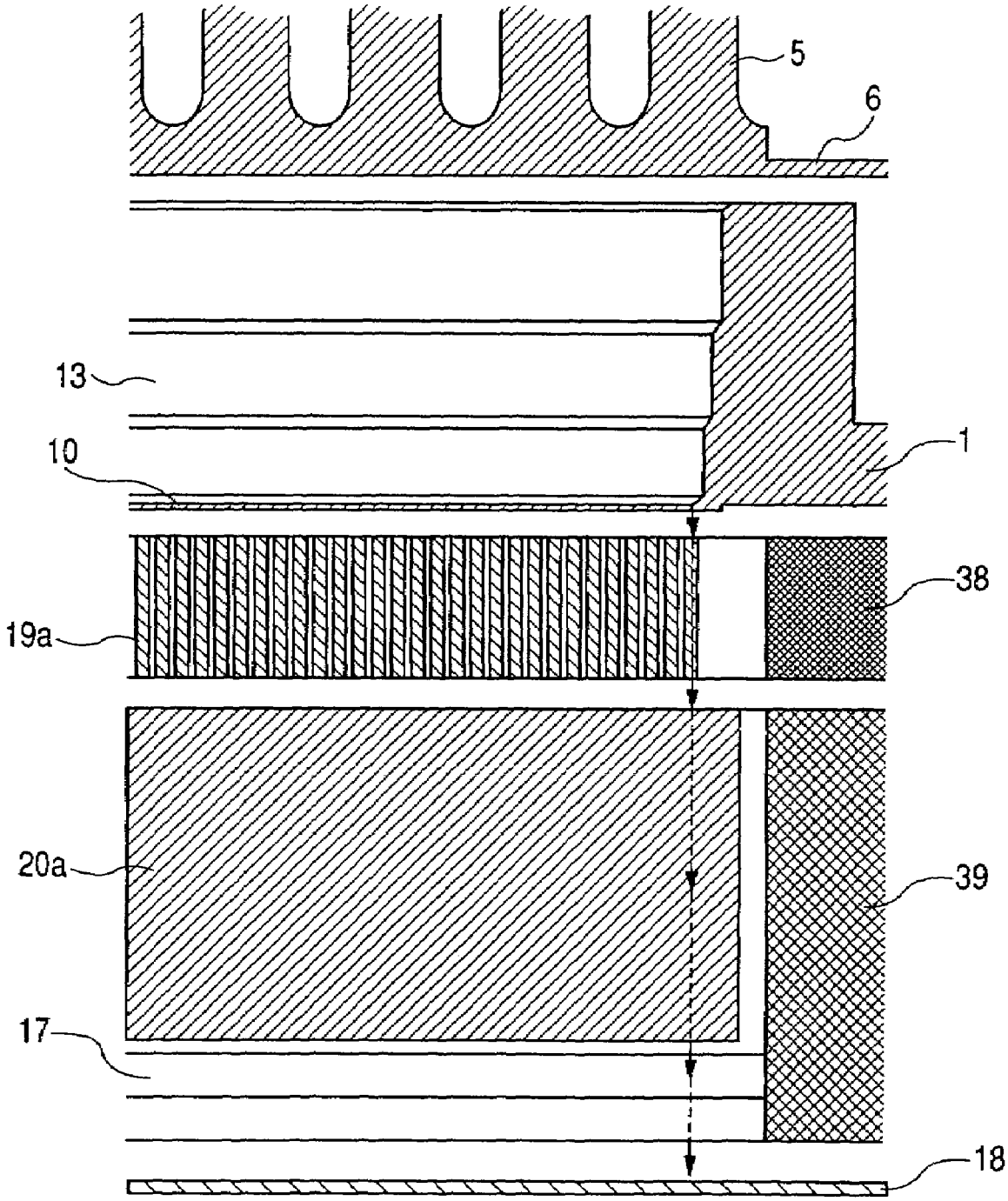
FIG. 11 shows the longitudinal sectional view of the center part of the ink-jet head of FIG. 8.

FIG. 8 is a partial cut-way view of an ink-jet head which uses the droplet generator of this invention. The front right quarter of the ink-jet head is cut away to show the appearance of the whole ink-jet head and the internal structure of the head. FIG. 9 and FIG. 10 respectively show the transverse sectional views of the center part of the ink-jet head of FIG. 8. FIG. 10 is the magnified view of FIG. 9 to explain the flying status of ink droplets. FIG. 11 shows the longitudinal sectional view of the center part of the ink-jet head of FIG. 8.

The ink-jet head is equipped with the above-explained droplet generator of FIG. 1, charge electrode section, and deflection electrode and droplet recovery section. The droplet generator, charge electrode section 38, and deflection electrode and droplet recovery section 39 are mounted in a body on ink-jet head base 40 as shown FIGS. 8 and 9. Head base 40 contains grooves to be engaged with these units. These grooves are provided for exact positioning of respective droplet generator, charge electrode section 38, and deflection electrode and droplet recovery section 39 in the ink-jet head and easy assembly of an ink-jet head.

Next will be explained the structures of the charge electrode section 38 and the deflection electrode and droplet recovery section 39. Charge electrode section 38 is made of an elongate slit structure and disposed so that liquid ejected from the droplet generator may fly through the center of the slit or its vicinity. As shown in FIG. 10, the distance between orifice 10 of the droplet generator and the charge electrode 38 is determined so that the slit of the charge electrode section 38 may come in the area in which the liquid ejected from the orifice is separated into droplets. The slit of the charge electrode section has charge electrodes 19 on both surfaces of the slit as shown in FIG. 10. The quantity of charge of separated droplets can be controlled by applying a preset voltage to the charge electrodes.

Charge electrode 19 is a band-like electrode fit for each orifice 10 as shown in FIG. 11 and can control electric charges for each orifice 10. To avoid charging cross-talk of ink droplets formed by orifices, it is necessary to make the distance between the charge electrode 19*a* and 19*b* and the liquid stream and droplets shorter than the distance between orifices 10. A certain gap is required to prevent liquid ejected from orifice 10 from touching charge electrode 19. However, if the gap is too wide, the distance between orifices must be increased. Judging from this, it is necessary to determine the size and accuracy of the gap between the charge electrode and liquid ejected from orifice 10. This embodiment can suppress the generation of charging cross-talk between orifices almost completely by determining 300 micrometers as the orifice-orifice distance and 200 micrometers as the gap between the charge electrode and the liquid center.

Droplet recovery section 39 like charge electrode section 38 is also made of a slit structure. This slit structure contains deflection electrode (deflector) section 20. The deflection electrode section 20 contains two opposite electrodes 20*a* and 20*b*. However, unlike charge electrodes 19*a* and 19*b*, different voltages are applied to these deflection electrodes to generate an electric field between the opposite electrodes. The gap between the droplet recovery electrodes is approximately equal to that between charge electrodes 19. Ink droplets charged by charge electrodes 19 are shifted by the electric field between deflection electrodes while flying through a space between deflection electrodes 20*a* and 20*b* and attracted to the wall of deflection electrode 20*a* for droplet recovery. A droplet recovery port is provided under deflection electrode 20*a*. Droplet recovery section 39 contains droplet recovery channel 17 which is connected to the recovery port. Pump 26 is connected to droplet recovery channel 17. Pump 26 sucks ink droplets and air together near the recovery port. A minus voltage is applied to deflection electrode 20*a* for droplet recovery if deflection electrode 20*b* not for recovery is grounded and ink droplets are positively charged by charge electrodes 19. If ink droplets are negatively charged, a positive voltage is applied to deflection electrode 20*a* for droplet recovery. The negative-charged ink droplets are attracted to recovery deflection electrode 20*a* by an electrostatic force. The quantity of deflection of charged droplets can be easily calculated from the length of deflection electrode 20, the gap between electrodes, the quantity of charge applied to droplet, the droplet flying speed, and the voltage applied to deflection electrode 20. It is necessary to set so that droplets of a preset charge quantity range may reach deflection electrode 20*a* for recovery without fail. Needless to say, droplets that are not attracted by charge electrodes 19 are not deflected by deflection electrode 20 and fly straight onto print material 18. Further, as deflection electrode 20 unlike charge electrode 19 need not control each orifice 10, the electrode is provided to cover the whole droplet channel through which droplets fly from orifices 10.

These three units, the droplet generator, charge electrode section 38, and deflection electrode and droplet recovery section 39, are exactly mounted in a body on ink-jet head base 40 to form an ink-jet head.

Figure 12:
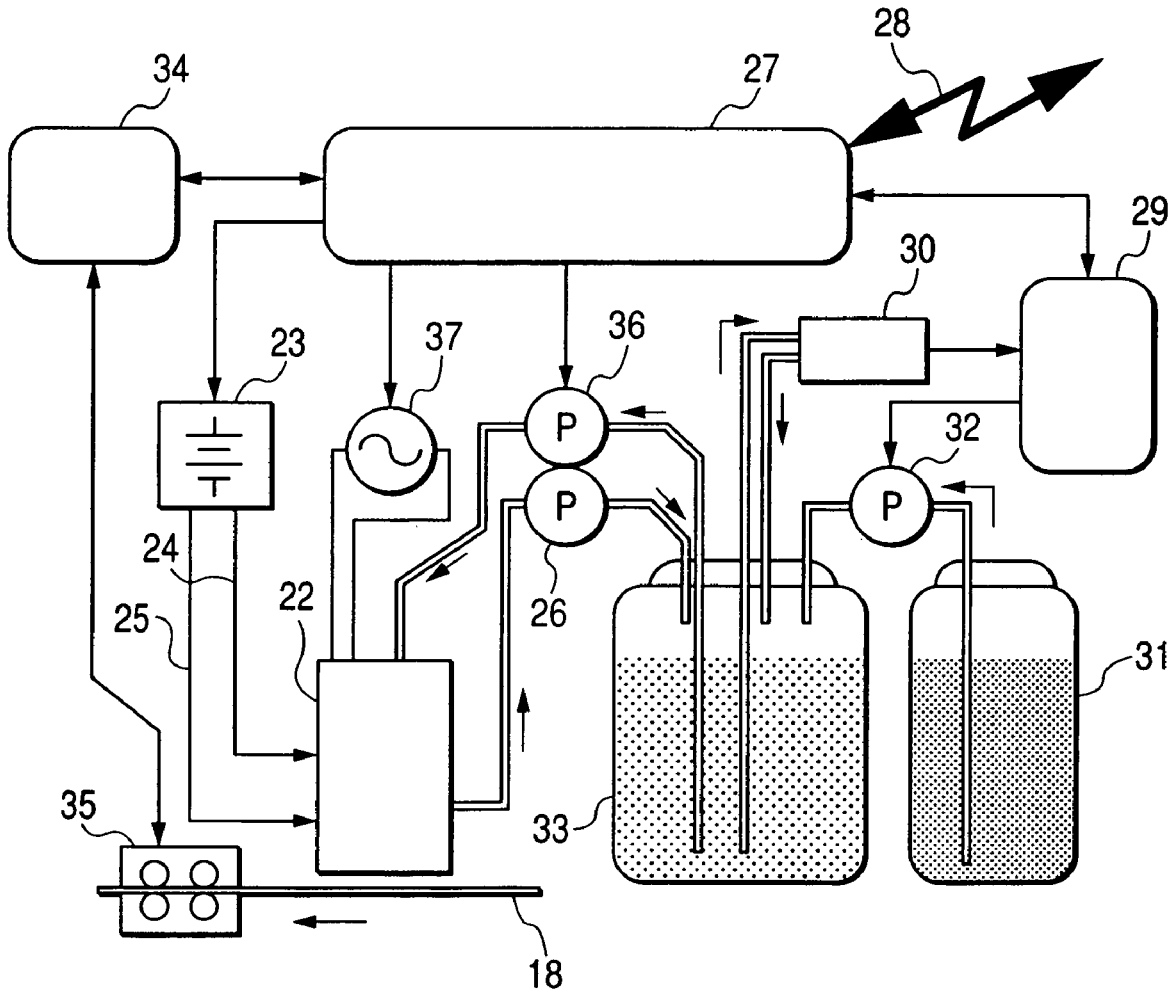
FIG. 12 shows the configuration of the whole ink-jet apparatus equipped with the ink-jet head of this invention.

Last, the configuration of the whole ink-jet recording apparatus which is equipped with an ink-jet head of this invention will be explained with reference to FIG. 12. The ink-jet recording apparatus contains an ink-jet drive section, an ink concentration control mechanism, and a recording media delivery control mechanism.

The ink-jet drive section is equipped with an ink-jet head, ink tank 33, piezoelectric element driving power supply 37 for applying a.c. voltage to piezoelectric element 3, control voltage supply 23 which applies voltages to charge electrodes 19 to charge ink droplets and deflection electrode 20 to deflect the movement of droplets, pumps 36 and 26 which supply ink to the ink-jet head and sucks unused droplets, and main control section 27 which control these units.

The ink concentration control mechanism works to control the concentration of ink to be supplied to the ink-jet head in ink tank 33. The ink concentration control mechanism is equipped with means to measure the concentration of ink in ink tank 33, solvent tank 31 which stores a solvent to dilute ink in ink tank 33, pump 32 to transfer solvent from solvent tank 31 to ink tank 33 in the ink-jet drive section, and ink concentration control section 29 to control these components.

The recording media delivery control mechanism is equipped with media delivery mechanism 35 and delivery control section 34.

When receiving print pattern data 28, main control section 27 of the ink-jet drive section controls liquid supply and recovery pumps 36 and 26, piezoelectric element driving power supply 37, and control voltage supply 23 which applies charging and deflecting voltages so that ink may be ejected according to the print pattern data 28. The ink ejection control is done by changing a condition of supplying voltages to charge electrodes 19 for each orifice. Main control section 27 in the ink-jet drive section communicates with media delivery control section 34 of the media delivery control mechanism to handle recoding media (print materials 18). Main control section 27 in the ink-jet drive section also communicates with ink concentration control section 29 to check whether the concentration of ink in ink tank 33 is in a preset concentration range and supplies ink of a preset concentration to the ink-jet head.

The concentration controlling method, media delivery controlling method, and head drive controlling method depend upon properties of ink to be ejected and pattern recording conditions. The conditions must be set appropriately.

Generally, an ink-jet apparatus is used to form characters and images by patterning color inks. The continuous multi-orifice ink-jet apparatus of this invention is a high-stability droplet generator of high reliability and high maintainability in comparison with general ink-jet apparatus. Accordingly, the apparatus of this invention is applicable to manufacturing equipment of using liquid patterning such as electronic devices that require high reliability, high maintainability, and high stability.

The above structures have the following effects:

The liquid ejecting means is made of a first unit which contains an elongate ink chamber having a row of orifices and a second unit which fixes a resonator (resonance vibration member) and a piezoelectric element which is a vibrating means. When the liquid ejecting means is disassembled, one end of the ink chamber formed in the first unit is open. Therefore, the structure of the liquid ejecting means is simple and the ink chamber can be easily washed.

The second unit of the above liquid ejecting means is equipped with a diaphragm structure that separates the resonator from the piezoelectric element which is a vibration means. Therefore, this simple structure can prevent vibrations of the piezoelectric element and resonator from transferring to the whole unit without any special vibration insulator such as acoustic materials.

Further, in the liquid ejecting means of the above structure, a diaphragm made of a thin member is provided on a position which is close to and opposite to the open surface of the ink chamber of the first unit. The piezoelectric element and the resonator are provided in the side of the diaphragm which does not face to the ink chamber. Therefore, no acoustic material or liquid seal material need be placed near the piezoelectric element and the resonator. This can simplify the structure and completely prevent unwanted vibrations from propagating to the whole unit through an acoustic material or liquid seal material.

Further, the liquid ejecting means has no engaging part except the bonding part of the diaphragm in the whole periphery of the piezoelectric element and the resonator including the longitudinal peripheries of them. Therefore, the vibrations of the piezoelectric element and the resonator can be easily stabilized. In addition, only the surface of the diaphragm is in contact with the liquid to vibrate thereof and no other part (the piezoelectric element and the resonator) is in contact with the liquid. Therefore, no other vibration than the vibration made by the diaphragm will ever be applied to the liquid.

This contributes to provision of a continuous multi-orifice ink-jet apparatus of high stability, high reliability and high maintainability.

The effect of the first structure in addition to the basic structure is as follows:

Thanks to the plurality of rod-like structures of the resonator of the second unit, the flexible motion of the resonator can be reduced along the row of the orifices and at the same time, the diaphragm can generate uniform vibrations along the row of the orifices. Further, since the elongate structure of the resonator enables flexible motion along the row of orifices, vibrations of greater amplitude can be obtained from small vibration energy of the piezoelectric element.

Further, a bonding structure is provided on one end surface of the plurality of rod-like structures which does not face to the diaphragm. This can keep the rod-like resonator stable during vibration.

The effect of the second structure is as follows:

The length of the rod-like resonator is determined to have a resonance point near the vibration frequency of the piezoelectric element and amplifies the vibration of a small piezoelectric element. However, the vibration amplification level steeply increases near the resonance frequency of the rod-like structure and it is difficult to stabilize the magnitude of the amplitude. As already described, it is possible to form a vibration area which enables comparatively broad vibration amplitude by providing at least one step on the resonator since the resonators have a plurality of resonance frequencies near a preset vibration frequency. This makes the vibration frequency of the piezoelectric element which is a vibration source as a frequency in the broad frequency area. With this, the vibration gain can be stabilized.

The effect of the third structure is as follows: The liquid in the ink chamber also has a certain resonance frequency due to the length of the ink chamber. When the liquid resonates at this resonance frequency, the behavior of the liquid may be unstable. This unstable vibration factor of the liquid can be excluded by providing a step which is fully shorter than the vibration frequency in the ink chamber to make the resonance frequency of the liquid due to the length of the chamber higher than the vibration frequency. Particularly, vibrations along the row of orifices may cause irregularity of droplets ejected from the orifices. These vibrations along the row of orifices can be suppressed by providing grooves or steps at intervals which make their frequencies higher than the vibration frequency on the walls of the ink chamber vertically to the diaphragm surface.

Contrarily, vibrations propagating from the diaphragm towards the orifices should preferably have a certain effect of amplification. However, the vibration amplification level steeply increases near the resonance frequency and the magnitude of amplification is hardly stabilized. As described above, it is possible to form a frequency area which enables amplitude of comparatively broad liquid vibrations by setting the intervals of grooves and steps in parallel with the diaphragm so that the resonance frequency of the liquid may be the plurality of resonance frequencies near the preset vibration frequency. This makes the vibration frequency of the piezoelectric element which is a vibration source as a frequency in the broad frequency area. With this, the vibration gain can be stabilized. Needless to say, the resonance vibration of liquid in the ink chamber can be prevented by providing a plurality of grooves or steps at intervals that can make the frequencies higher than the vibration frequency as well as the grooves and steps which are vertical to the diaphragm surface.

For the above reasons, the basic structure and the three structures of this invention enable provision of a continuous multi-orifice ink-jet apparatus of high stability, high reliability and high maintainability.

What is claimed is:

1. A droplet continuous ink-jet generator comprising:

a first unit having an elongate liquid chamber one end thereof is open and at least one row of orifices disposed in an other end of the elongate liquid chamber opposite to the open end in the longitudinal direction of the elongate liquid chamber;

a second unit having an elongate diaphragm disposed along the elongate liquid chamber and having a side facing the open end, and a plurality of vibrating sections provided on the diaphragm and extending in a longitudinal direction of the elongate liquid chamber and located on a side opposite the diaphragm away from the liquid chamber and not in contact with liquid contained in the liquid chamber, the plurality of vibrating sections and diaphragm being cut from the same material such that the vibrating sections and diaphragm form a single monolithic structure;

a vibrating apparatus provided on the top of the vibrating sections; and a stationary section to fix the vibrating apparatus, wherein the diaphragm of the second unit is provided adjacent to and facing the open end of the liquid chamber of the first unit.

2. The droplet generator of claim 1, wherein the plurality of vibrators are formed by a plurality of columnar structures disposed in the longitudinal direction of the elongate diaphragm.

3. The droplet generator of claim 2, wherein one end of the plurality of columnar structures opposite to the diaphragm is combined in a body with a structure having a preset area.

4. The droplet generator of claim 1, wherein the vibrating apparatus is made of a lamination of two or more layers of piezoelectric elements.

5. The droplet generator of claim 1, wherein the liquid chamber of the first unit contains at least one step on the wall between the open end and the orifices.

6. The droplet generator of claim 1, wherein the liquid chamber of the first unit is provided with multiple steps in a direction of liquid flowing from the orifices.

7. The droplet generator of claim 5, wherein a position and interval of each step in the elongate liquid chamber of the first unit is determined so that a distance between the open end and the step, a distance between orifices and the step, and a step-step distance are shorter than the wavelength of vibration to be expected from the vibration frequency and the acoustic velocity of the liquid to be used.

8. The droplet generator of claim 5, wherein the a position and interval of each step in the elongate liquid chamber of the first unit is determined so that a distance between the open end and the step, a distance between orifices and the step, and a step-step distance are shorter or longer than the wavelength of vibration to be expected from the vibration frequency and the acoustic velocity of the liquid to be used.

9. The droplet generator of claim 2, wherein the plurality of columnar structures provide with at least one step.

10. The droplet generator of claim 1, wherein the vibrating apparatus applies vibrations of up to about 10 kHz to eject a plurality of liquid droplets continuously.

11. An ink-jet recording device comprising:

a first unit having an elongate liquid chamber one end thereof is open and at least one row of orifices disposed in an other end of the elongate liquid chamber opposite to the open end in the longitudinal direction of the elongate liquid chamber;

a second unit having an elongate diaphragm disposed along the elongate liquid chamber and having a side facing the open end, and a plurality of vibrating sections provided on the diaphragm, and extending in a longitudinal direction of the elongate liquid chamber and located on a side opposite side the diaphragm away from the liquid chamber and not in contact with liquid contained in the liquid chamber, the plurality of vibrating sections and diaphragm being cut from the same material such that the vibrating sections and diaphragm form a single monolithic structure;

a vibrating apparatus provided on the top of the vibrating sections; and a stationary section to fix the vibrating apparatus, wherein the diaphragm of the second unit is provided adjacent to and facing the open end of the liquid chamber of the first unit, and includes a plurality of electrodes provided along the ejection of liquid droplets outside the orifices to selectively charge liquid droplets ejected from the orifices, an electrode apparatus to deflect the charged droplets and a recovery apparatus to recover liquid droplets.

12. The droplet generator of claim 1, further comprising:

a liquid supply route configured to supply a liquid to the elongate liquid chamber of the first unit in a vertical direction relative to the elongate liquid chamber.

13. The ink-jet recording device of claim 11, further comprising:

a liquid supply route configured to supply a liquid to the elongate liquid chamber of the first unit in a vertical direction relative to the elongate liquid chamber.

* * * * *